US009523958B2

(12) United States Patent
Onishi

(10) Patent No.: US 9,523,958 B2
(45) Date of Patent: Dec. 20, 2016

(54) IMAGE FORMING APPARATUS

(71) Applicant: KYOCERA Document Solutions Inc., Osaka (JP)

(72) Inventor: Masato Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/977,212

(22) Filed: Dec. 21, 2015

(65) Prior Publication Data

US 2016/0187838 A1 Jun. 30, 2016

(30) Foreign Application Priority Data

Dec. 25, 2014 (JP) ..... 2014-261888
Dec. 25, 2014 (JP) ..... 2014-262397

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
USPC ..... 399/107
See application file for complete search history.

(56) References Cited

U.S. PATENT DOCUMENTS 8,145,094 B2 3/2012 Takemoto
2014/0203697 A1* 7/2014 Wada ..... G03G 21/1633 312/333

FOREIGN PATENT DOCUMENTS

JP 2004-004367 A 1/2004
JP 2009-265540 A 11/2009
JP 2010-210897 A 9/2010

* cited by examiner

*Primary Examiner* — Clayton E Laballe
*Assistant Examiner* — Victor Verbitsky
(74) *Attorney, Agent, or Firm* — Studebaker & Brackett PC

(57) ABSTRACT

An image forming apparatus (1) includes a case body (3) having a hollow space (2) in which a sheet storing part (6) and an image forming part (7) are to be housed. The case body (3) has four pillars (31), (32), (33), (34) and a conveying frame (39). The four pillars (31), (32), (33), (34) are respectively disposed at four corners of the hollow space (2). The conveying frame (39) is disposed between adjacent two pillars (32), (34) of the four pillars (31), (32), (33), (34) and configured to form a conveying path (36) of a sheet from the sheet storing part (6) to the image forming part (7). The conveying frame (39) has at least one vertical column-shaped projection (61) on a pillar side end face. The vertical column-shaped projection (61) is integrally coupled to the pillar (32).

10 Claims, 7 Drawing Sheets

IMAGE FORMING APPARATUS

INCORPORATION BY REFERENCE

This application is based on and claims the benefit of priorities from Japanese Patent application No. 2014-262397 filed on Dec. 25, 2014 and Japanese Patent application No. 2014-261888 filed on Dec. 25, 2014, the entire contents of which are incorporated herein by reference.

BACKGROUND

The present disclosure relates to an image forming apparatus including a case body which houses an image forming part.

In an image forming apparatus, a case body in which an image forming part and a sheet storing part are to be housed generally has a rectangular parallele piped-shaped structure having a rectangular bottom plate, pillars erected at four corners of the bottom plate, front and rear side plates and left and right side plates which are disposed between the adjacent pillars. Such a case body can have a rigidity by rigidly fixing each of the pillars and each of the side plates to the bottom plate. Also, weight reduction of the case body is progressed with a request for weight reduction of the image forming apparatus.

As one of the measures for weight reduction of the case body, weight reduction of the bottom plate is exemplified. However, in a case where the bottom plate is reduced in weight, there is a concern about lowering of the rigidity of the entire of the case body.

Accordingly, there is an image forming apparatus configured to enhance rigidity of a front side plate by supporting the front side plate between a pair of pillars, each of which has a U-shaped cross section. In addition, there is an image forming apparatus having a square column-shaped structure by securing a side edge portion of the front side plate or the rear side plate folded in an L-shaped cross section and a pillar having an L-shaped cross section. Further, there is an image forming apparatus having a case body provided with a base frame constructed by connecting four rectangular pipes to each other in a grid pattern.

However, in the case body of the image forming apparatus described above, since an aperture through which a sheet feeding cartridge, which is the sheet storing part, is to be attached/detached is formed in a lower portion of the front side plate, sufficient rigidity cannot be obtained. Also, in a case where the rectangular pipes are connected to each other in the grid pattern, because of a heavy weight of the rectangular pipe, the weight reduction of the case body is impossible. In addition, since connection strength between the base plate and the pillars is not sufficient, rigidity of the pillars cannot be obtained.

SUMMARY

In accordance with an embodiment of the present disclosure, an image forming apparatus includes a case body having a hollow space in which a sheet storing part and an image forming part are to be housed. The case body has four pillars and a conveying frame. The four pillars are respectively disposed at four corners of the hollow space. The conveying frame is disposed between adjacent two pillars of the four pillars and configured to form a conveying path of a sheet from the sheet storing part to the image forming part. The conveying frame has at least one vertical column-shaped projection on a pillar side end face. The vertical column-shaped projection is integrally coupled to the pillar.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
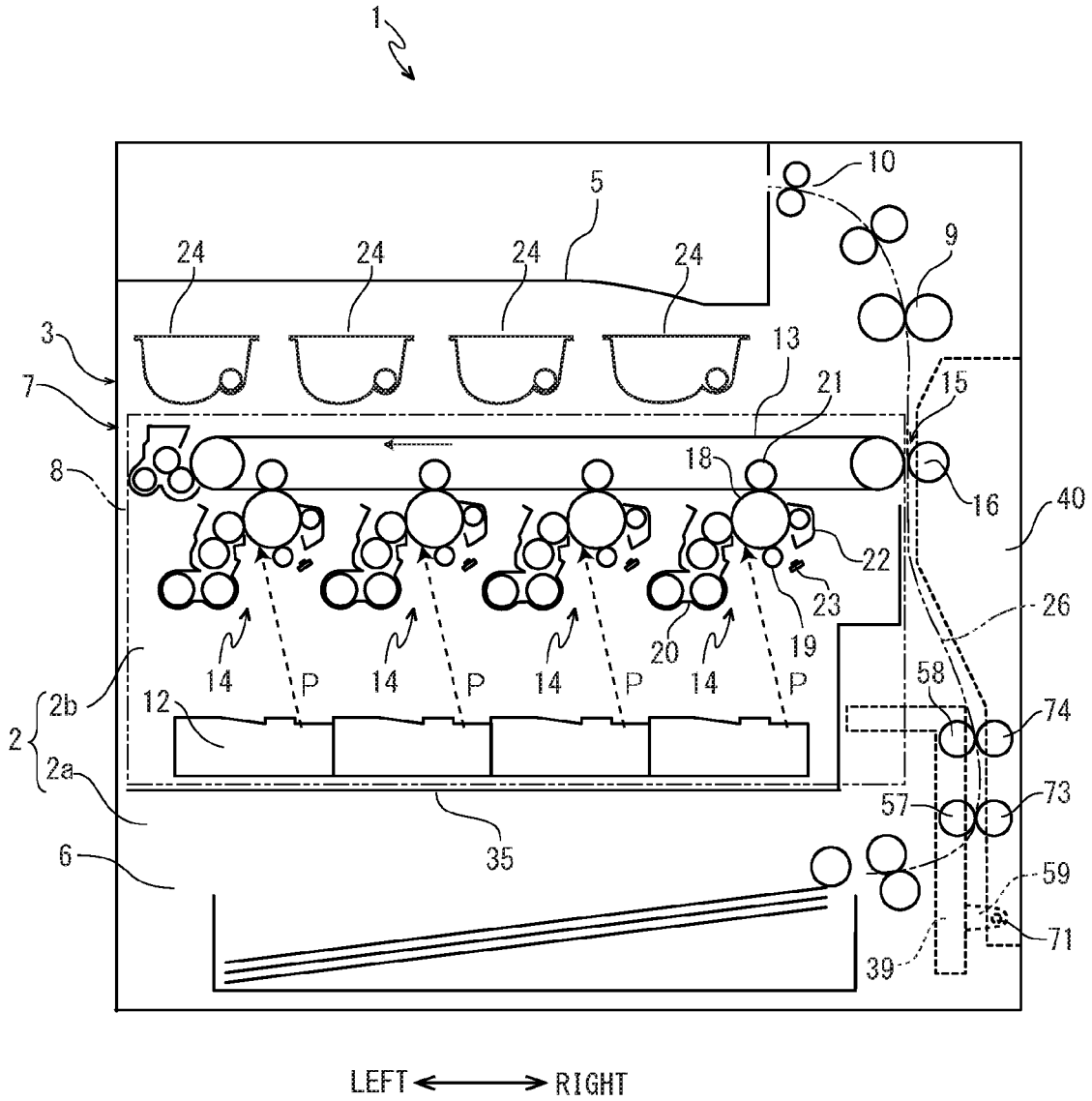
FIG. 1 is a schematic view showing an outline of a color printer according to an embodiment of the present disclosure.

First, with reference to FIG. 1, the entire structure of a color printer 1 (image forming apparatus) will be described. FIG. 1 is a schematic diagram schematically showing the color printer according to an embodiment of the present disclosure. In the following description, a front side of the sheet plane of FIG. 1 shows a front side of the color printer 1 and left and right directions are based on a direction viewed from the front side of the color printer 1.

The color printer 1 is provided with a case body 3 having an approximately rectangular parallele piped hollow space 2. On an upper face of the case body 3, an ejected sheet tray 5 is provided. In a lower space of the hollow space 2, a sheet feeding cassette 6 as a sheet storing part is housed and in an upper space of the hollow space 2, an image forming part 7 is provided.

The image forming part 7 includes an image forming device 8 configured to form toner image on a sheet, a fixing device 9 configured to fix the toner image on the sheet and a sheet ejecting device 10 configured to eject the sheet on which the toner image is fixed to the ejected sheet tray 5. The image forming device 8 has an exposure device 12 containing a laser scanning unit (LSU), an intermediate transferring belt 13 bridged around rollers, four image forming units 14 arranged side by side along the lower side of the intermediate transferring belt 13 and a second transferring roller 16 configured to form a second transferring part 15 with the intermediate transferring belt 13. The image forming unit 14 has a photosensitive drum 18 rotatably provided and a charger 19, a development device 20, a transferring roller 21, a cleaning device 22 and a static eliminator 23 which are arranged along a rotating direction of the photosensitive drum 18. Above the image forming device 8, toner containers 24 respectively storing different color toner are stored.

The fixing device 9 is arranged above the second transferring part 15 and the sheet ejecting device 10 is arranged above the fixing device 9. Along a right side of the hollow space 2, a sheet conveying path 26 is formed extending from the sheet feeding cassette 6 to the sheet ejecting device 10 through the second transferring part 15 and the fixing device 9.

The image forming device 8, the fixing device 9 and the sheet ejecting device 10 each have positioning pins (not shown) configured to be positioned with respect to the case body 3.

Next, the operation of forming an image by the color printer 1 having such a configuration will be described. In each image forming unit 14 of the image forming device 8, after the surface of the photosensitive drum 18 is charged by the charger 19, the exposure device 12 exposes the surface of the photosensitive drum 18 with a laser light (refer to an arrow p in FIG. 1) to form an electrostatic latent image on the surface of the photosensitive drum 18. The electrostatic latent image is then developed into a toner image of corresponding color by the developing device 20 with the toner supplied from the corresponding toner container 24. The toner image is first-transferred on the intermediate transferring belt 13 by the transferring roller 21. The above-mentioned operation is repeated in order by the image forming units 14, thereby forming a full color toner image onto the intermediate transferring belt 13. Incidentally, toner and residual electric charge remained on the photosensitive drum 18 is removed by the cleaning device 22 and the static eliminator 23, respectively.

On the other hand, the sheet fed from the sheet feeding cassette 6 is conveyed to the second transferring part 15 in a suitable timing for the above-mentioned image forming operation. Then, in the second transferring part 15, the full color toner image on the intermediate transferring belt 13 is second-transferred onto the sheet. The sheet with the second-transferred toner image is conveyed to a downstream side along the sheet conveying path 26 to enter the fixing device 9, and then, the toner image is fixed on the sheet in the fixing device 9. The sheet with the fixed toner image is ejected from the sheet ejecting device 10 onto the ejected sheet tray 5.

Figure 2:
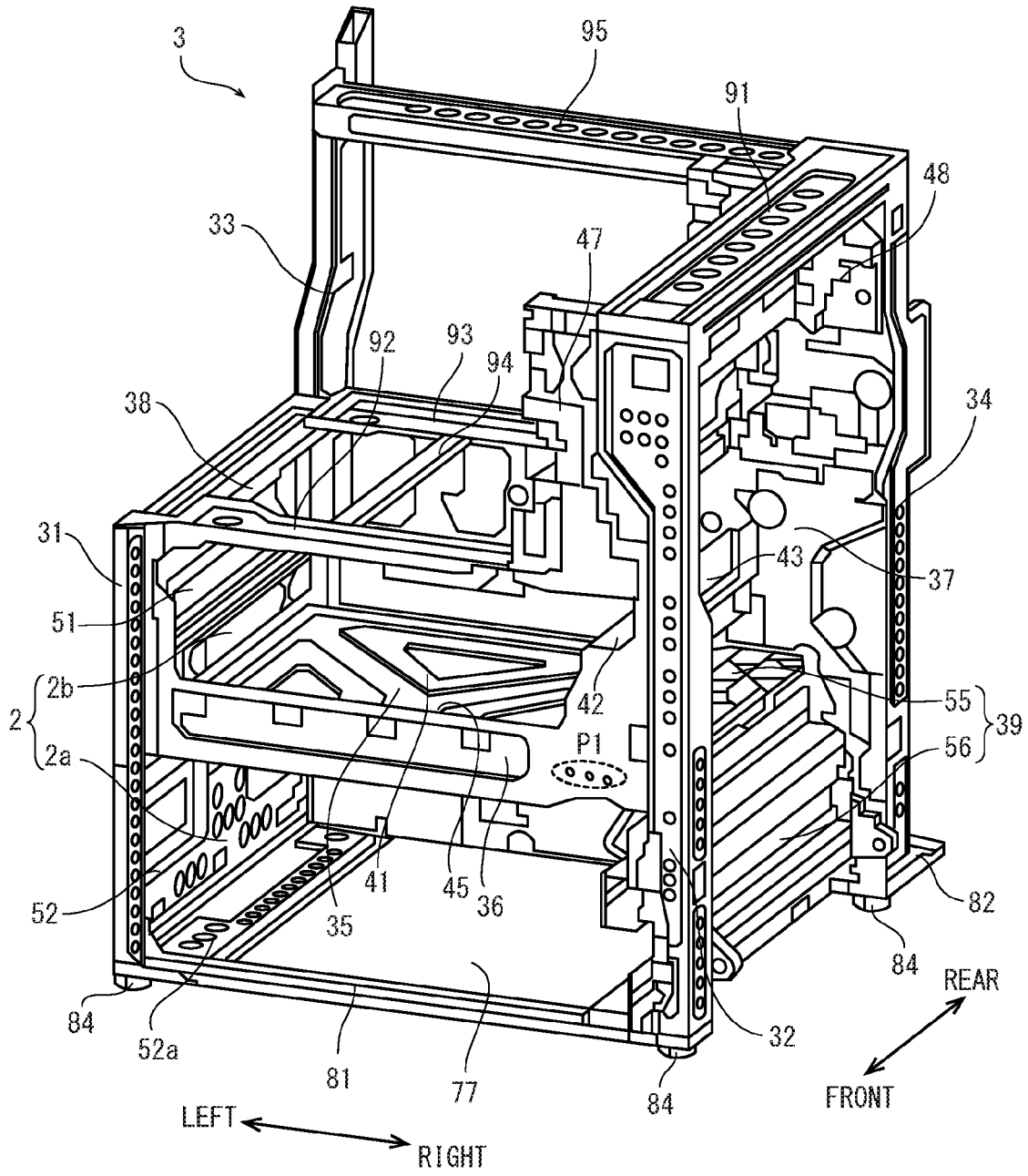
FIG. 2 is a perspective view showing an entire structure of a case body in the color printer according to the embodiment of the present disclosure.
Figure 3:
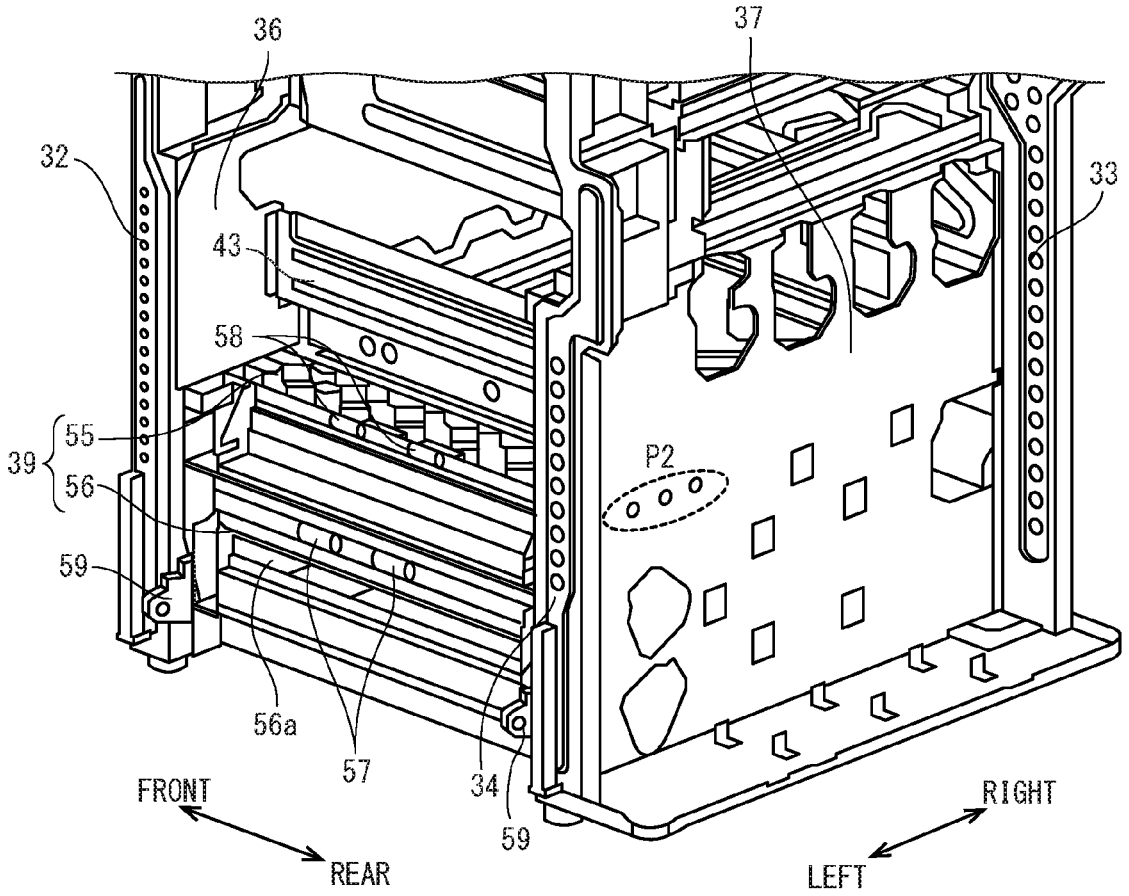
FIG. 3 is a perspective view showing the case body viewed from a rear side, in the color printer according to the embodiment of the present disclosure.
Figure 4:
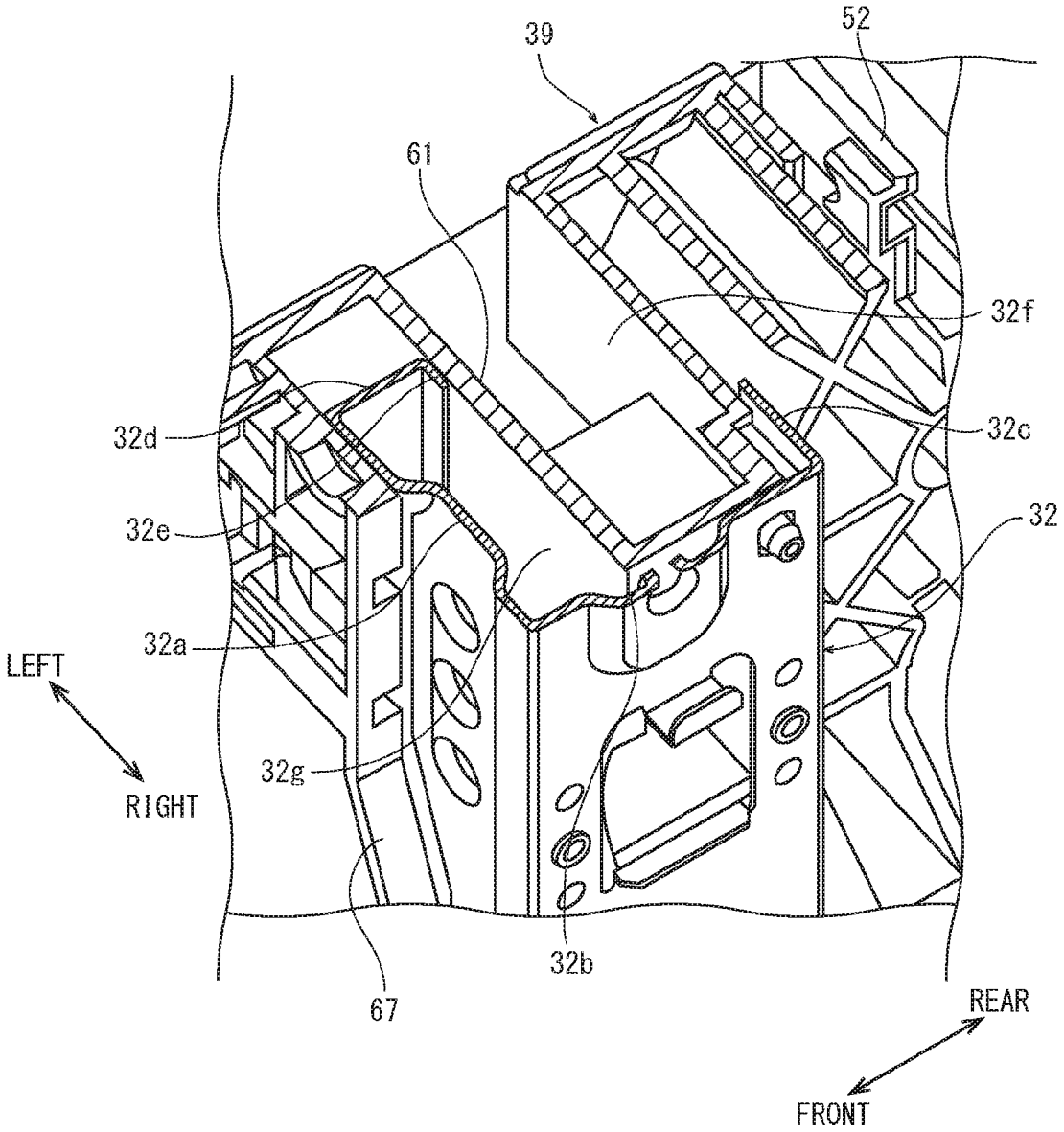
FIG. 4 is a sectional perspective view showing a structure of a pillar of the case body, in the color printer according to the embodiment of the present disclosure.
Figure 5:
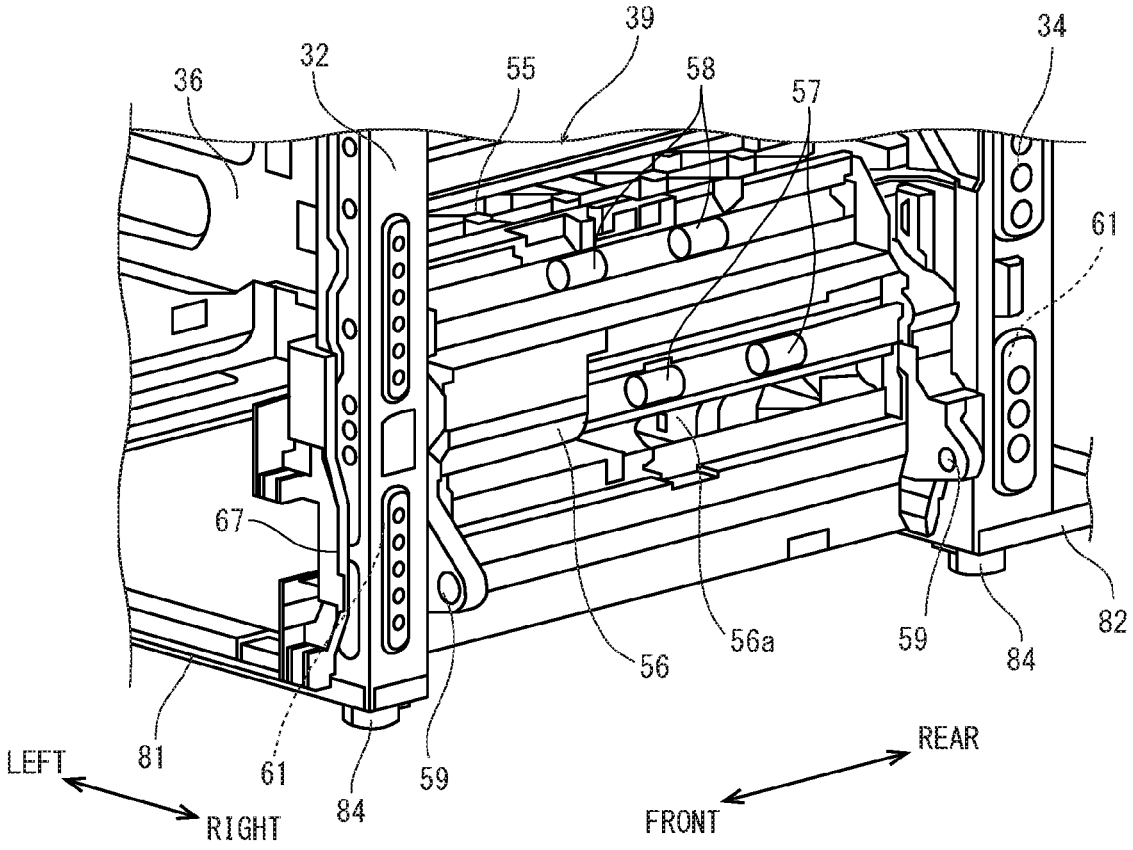
FIG. 5 is a perspective view showing a conveying frame of the case body, in the color printer according to the embodiment of the present disclosure.
Figure 6:
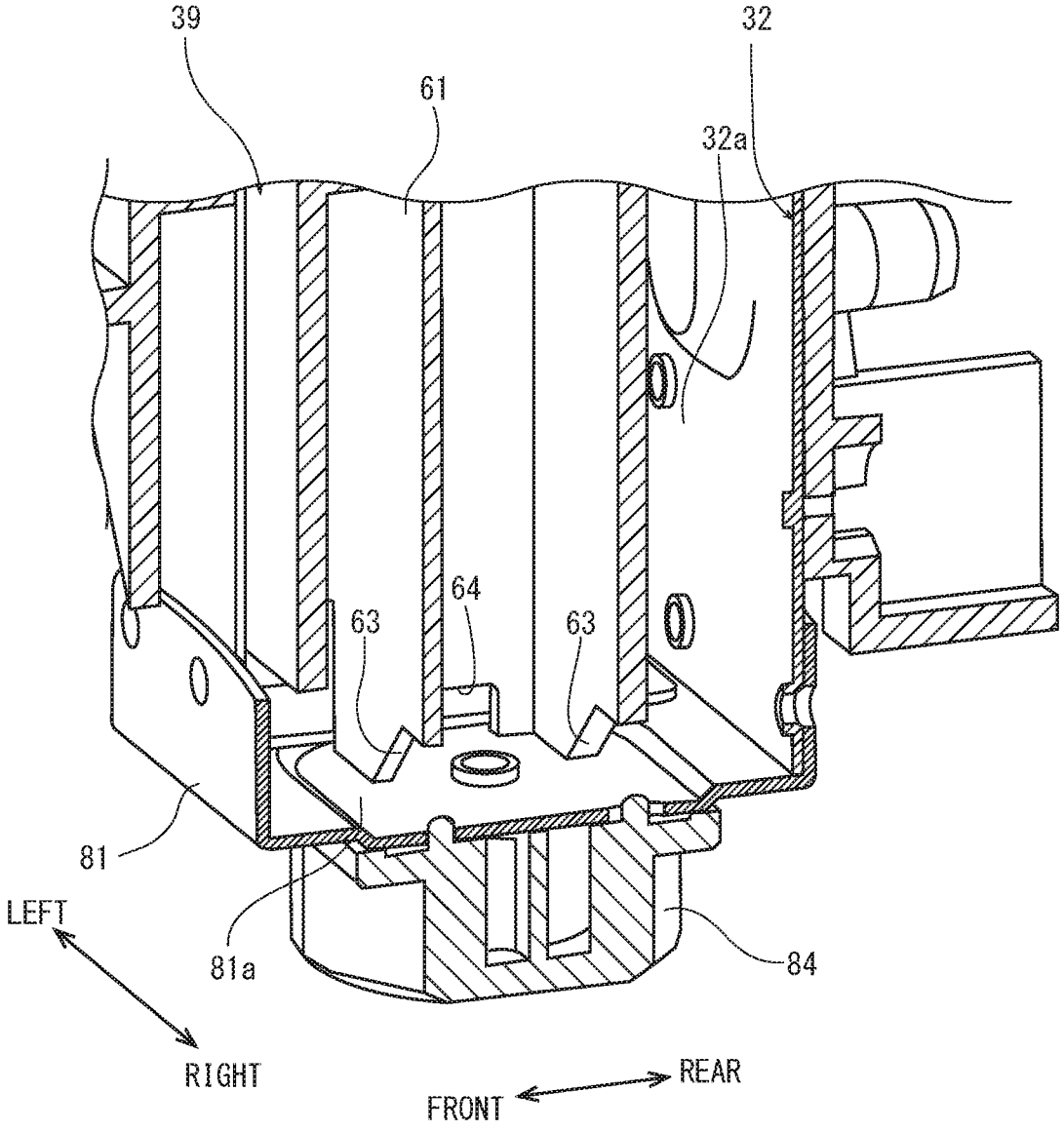
FIG. 6 is a sectional perspective view showing a lower end portion of the pillar of the case body, in the color printer according to the embodiment of the present disclosure.
Figure 7:
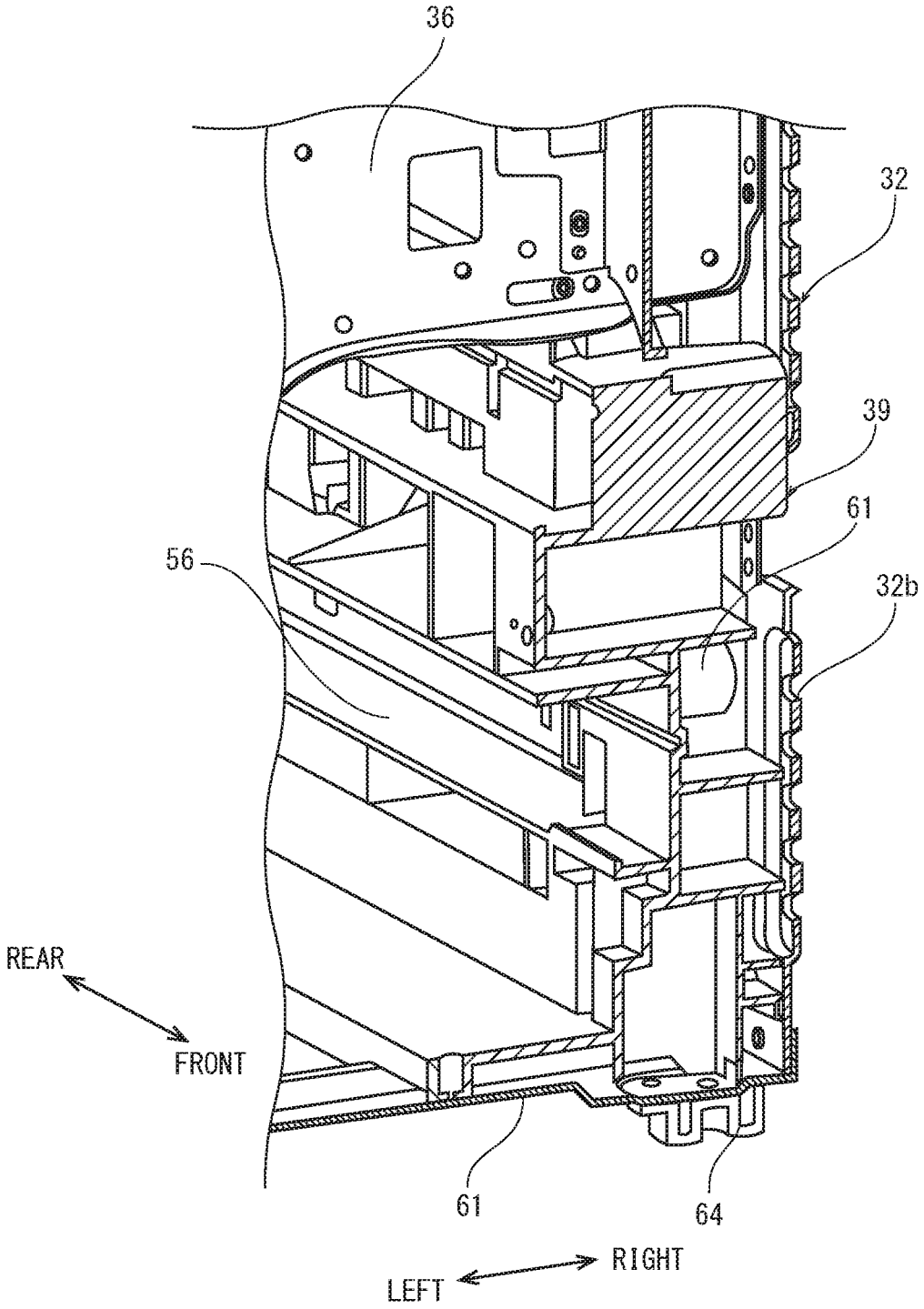
FIG. 7 is a sectional perspective view showing the pillar and the conveying frame of the case body, in the color printer according to the embodiment of the present disclosure.

Next, with reference to FIG. 2 to FIG. 7, the case body 3 will be described. FIG. 2 is a perspective view showing the entire of the case body viewed from the front right side; FIG. 3 is a perspective view showing the case body viewed from the rear side; FIG. 4 is a sectional perspective view showing a structure of a pillar of the case body; FIG. 5 is a perspective view showing a conveying frame of the case body; FIG. 6 is a sectional perspective view showing a lower end portion of the pillar of the case body; and FIG. 7 is a sectional perspective view showing the conveying frame and the pillar of the case body.

As shown in FIG. 2 and FIG. 3, the case body 3 has; a front left pillar 31, a front right pillar 32, a rear left pillar 33 and a rear right pillar 34 which are respectively disposed at four corners of the hollow space 2; a rectangular partition plate 35 to partition the hollow space 2 into a lower space 2*a* and an upper space 2*b*; and a front side plate 36, a rear side plate 37, a left side plate 38 and a conveying frame 39 which are surrounding members respectively disposed at four sides of the hollow space 2. Outside of the front side plate 36, the rear side plate 37 and the left side plate 38 are covered with respective exterior covers (not shown). The outside of the conveying frame 39 is covered with a conveying unit 40 as an exterior cover (refer to FIG. 1).

The front left pillar 31, the front right pillar 32, the rear left pillar 33 and the rear right pillar 34 are made of a metallic material. The front right pillar 32 and the rear right pillar 34 are channel material-shaped members each having a U-shaped cross section of which a left side opens. The front right pillar 32, as shown in FIG. 4, has: a front wall portion 32*a*; a right wall portion 32*b* bent at right angles rearward from a right edge of the front wall portion 32*a*; and a rear wall portion 32*c* bent at right angles leftward from a rear edge of the right wall portion 32*b*. The front wall potion 32*a* and the right wall portion 32*b* have a substantially equal width, and the rear wall portion 32*c* has a width of one third of the width of the front wall portion 32*a*. Further, the front wall portion 32*a* is formed with a left wall portion 32*d* bent at right angles rearward from a left edge and a folded portion 32*e* folded at right angles rightward from a rear edge of the left wall portion 32*d*. The left wall portion 32*d* has a width of one third of the width of the right wall portion 32*b* and the folded portion 32*e* has a width smaller than that of the left wall portion 32*d*. By such construction, between the rear wall portion 32*c* and the folded portion 32*e*, a gap 32*f* opened on a left side is formed, and a hollow part 32*g* which is surrounded by the front wall portion 32*a*, the right wall portion 32*b* and the rear wall portion 32*c* is formed. The right wall portion 32*b* is formed with a plurality of positioning holes at predetermined intervals. The rear right pillar 34 has a similar structure as that of the front right pillar 32.

The front left pillar 31 and the rear left pillar 33 are each formed of an angular material-shaped member having a substantial L-shaped cross section, a channel material-shaped member having a U-shaped cross section, a rectangular pipe-shaped member or the like. Also, the front right pillar 32, the rear left pillar 33 and the rear right pillar 34 each have a length longer than a length of the front left pillar 31 and extend above the hollow space 2.

The partition plate 35, as shown in FIG. 2 and FIG. 3, has a rectangular base part 41, a stepped part 42 erected in a stepwise manner from a right edge of the base part 41 and a vertical wall part 43 erected from a right edge of the stepped part 42. In the base part 41, a plurality of reinforcement depressions are formed diagonally and along an outer circumference by press processing. The partition plate 35 is made of a metal plate material, for example.

The partition plate 35 is disposed away from a right side face of the case body 3 at intervals. And, a front left corner and a rear left corner of the partition plate 35 are respectively secured to the front left pillar 31 and the rear left pillar 33 by screws.

The front side plate 36 has an elongated rectangular shape with a substantially rectangular aperture 45 at a center thereof. Along a right end portion of an upper edge of the front side plate 36, a rectangular front mounting plate 47 is secured with screws. The front side plate 36 and the front mounting plate 47 are each made of a metal plate material, for example. The front side plate 36 is disposed on a front side of the upper space 2*b*, and is secured to the front left pillar 31 and the front right pillar 32 by screws and is also secured to a front end face of the partition plate 35 by screws. The front mounting plate 47 is secured to the front right pillar 32 by screws.

The rear side plate 37 has a rectangular shape, and along a right end portion of an upper edge thereof, a rectangular rear mounting plate 48 is secured by screws. The rear mounting plate 48 opposes to the front mounting plate 47 of the front side plate 36. The rear side plate 37 and the rear mounting plate 48 are each made of a metal plate material, for example. The rear side plate 37 is disposed on a rear side of both the upper and lower spaces 2*b*, 2*a*; and is secured to the rear left pillar 33 and the rear right pillar 34 by screws and is also secured to a rear end face of the partition plate 35 by screws. The rear mounting plate 48 is secured to the rear right pillar 4 by screws.

The front side plate 36 and the rear side plate 37 are formed with positioning holes (not shown) into which positioning pins formed in the image forming device 8 are to be inserted. Also, the front mounting plate 47 and the rear mounting plate 48 are formed with positioning hole (not shown) into which positioning pins formed in the fixing device 9 and the sheet ejecting device 10 are to be inserted.

The left side plate 38, as shown in FIG. 3, has an upper left side plate 51 and a lower left side plate 52 and is made of a metal plate material, for example. The upper left side plate 51 having an elongated rectangular shape is disposed on an upper halve of a left side of the upper space 2*b* and is secured to the front left pillar 31 and the rear left pillar 33 by screws. The lower left side plate 52 having an elongated rectangular shape is formed with a lower edge portion 52*a* bent rightward from a lower edge thereof. The lower left side plate 52 is disposed on a left side of the lower space 2*a*, and is secured to the front left pillar 31 and the rear left pillar 33 by screws and is also secured to a left end face of the partition plate 35 by screws.

Next, the conveying frame 39 will be described. The conveying frame 39 forms the sheet conveying path 26 from the sheet feeding cassette 6 to the second transferring part 15 with the conveying unit 40. The conveying frame 39, as shown in FIG. 2 and FIG. 3 or FIG. 5, has a horizontal guiding part 55 extending substantially horizontally and a vertical guiding part 56 bent downward from a right edge of the horizontal guiding part 55, and is made of a plastic material. On an upper face of the horizontal guiding part 55, a lattice-shaped rib is formed.

In a lower portion of the vertical guiding part 56, as shown in FIG. 5, an aperture 56*a* through which the sheet fed from the sheet feeding cassette 6 passes is formed. Above the aperture 56*a*, a conveying roller 57 is rotatably supported, and above the conveying roller 57, a resist roller 58 is rotatably supported. Also, at both sides of the aperture 56*a*, rotating supporting parts 59 configured to rotatably support the conveying unit 40 are respectively protruded.

The vertical guiding part 56 is formed with column-shaped projections 61 extending in a height direction at both sides of the rotating supporting parts 59. The column-shaped projection 61, as shown in FIG. 4, has a rectangular pipe shape of an elongated rectangle cross section. On a right side face of the column-shaped projection 61, a plurality of pins are erected along a height direction. Also, as shown in FIG. 6, at a lower end edge of the column-shaped projection 61, trapezoidal notches 63 are formed oppositely each other in the front and rear directions and rectangular notches 64 are formed oppositely each other in the left and right directions.

As shown in FIG. 4 and FIG. 5, the vertical guiding part 56 is formed with an outside wall part 67 protruding rightward along the height direction of the column-shaped projection 61 in front of the column-shaped projection 61. The outside wall part 67 is formed with a supporting part configure to support the exterior cover which covers the outside of the front side plate 36, for example.

The conveying frame 39 is disposed on a right side of the hollow space 2, and the horizontal guiding part 55 is secured to the front side plate 36 and the rear side plate 37 by screws under the stepped part 42 of the partition plate 35 (the screwed parts are indicated by P1 of FIG. 2 and P2 of FIG. 3) and is also secured to the front right pillar 32 and the rear right pillar 34 by screws.

Also, the column-shaped projections 61 formed in the vertical guiding part 56 respectively enter the hollow parts from the gaps formed at the left sides of the front right pillar 32 and the rear right pillar 34. In describing the front side column-shaped projection 61 with reference to FIG. 4, the front side column-shaped projection 61 enters the hollow part 32*g* from the gap 32*f* of the front left pillar 32, and the right side face abuts against an inner face of the right wall portion 32*b* of the front right pillar 32 (refer to FIG. 4 and FIG. 7). The pins erected on the right side of the front side column-shaped projection 61 are inserted into the positioning holes formed in the right wall portion 32*b*, and the column-shaped projection 61 and the front right pillar 32 are secured by screws. In addition, as shown in FIG. 4, a rear side face and a front side face of the column-shaped projection 61 respectively come into contact with the rear wall portion 32*c* and the folded portion 32*e* of the front right pillar 32. Further, the front wall portion 32*a* of the front right pillar 32 is sandwiched between the outside wall part 67 and the column-shaped projection 61 of the conveying frame 39.

Next, the conveying unit 40 will be described. As shown in FIG. 1, the conveying unit 40 is formed with rotating supporting shafts 71 rotatably supported to the rotating supporting parts 59 of the conveying frame 39, at a lower end thereof. Also, the conveying unit 40 rotatably supports the second transferring roller 16, a conveying roller 73 and a resist roller 74 respectively corresponding to the conveying roller 57 and the resist roller 58 that are supported by the conveying frame 39. The rotating supporting shafts 71 of the conveying unit 40 are rotatably supported to the rotating supporting parts 59 of the conveying frame 39 so that the conveying unit 40 is rotatably supported by the conveying frame 39.

If the conveying unit 40 is rotated in a counterclockwise direction of FIG. 1, the second transferring roller 16 supported by the conveying unit 40 opposes to the intermediate transferring belt 13. Also, the conveying roller 73 and the resist roller 74 are respectively brought into pressure contact with the conveying roller 57 and the resist roller 58 supported by the conveying frame 39. In this manner, the sheet conveying path 26 is formed. If the conveying unit 40 is rotated in a clockwise direction of FIG. 1, the sheet conveying path 26 is opened so as to carry out various processing operation, such as sheet jamming processing.

In addition, the case body 3, as shown in FIG. 2, has channel-shaped front beam 81 (supporting member) bridged between the lower ends of the front left pillar 31 and the front right pillar 32 and a rear beam 82 bridged between the lower ends of the rear left pillar 33 and the rear right pillar 34. The front beam 81 is secured to the lower edge portion 52*a* of the lower left side plate 52 of the left side plate 38 by screws. The lower ends of the front left pillar 31 and the front right pillar 32 are supported by rubber legs 84 via the front beam 81 and the lower ends of the rear left pillar 33 and the rear right pillar 34 are supported by rubber legs 84 via the rear beam 82.

As shown in FIG. 6, the front beam 81 formed with a shallow depression 81*a* at a right end portion thereof. The lower end of the front right pillar 32 abuts against a periphery of the depression 81*a*, and a lower end of the column-shaped projection 61 of the conveying frame 39 abuts against the depression 81*a*. In detail, four corners at the lower end of the column-shaped projection 61 abut against the depression 81*a*. In this manner, loads of the front right pillar 32 and the column-shaped projection 61 are applied to the rubber legs 84 via the front beam 81.

Further, the case body 3, as shown in FIG. 2, has a top plate 91 bridged between upper edges of the front mounting plate 47 and the rear mounting plate 48. Furthermore, the case body 3 has a front plate 92 bridged between the left side plate 38 and the front mounting plate 47 along the upper edge of the front side plate 36 and a rear plate 93 bridged between the left side plate 38 and the rear mounting plate 48 along the upper edge of the rear side plate. Still furthermore, the case body 3 has an intermediate beam 94 bridged between the front plate 92 and the rear plate 93 and an upper beam 95 bridged between the rear left pillar 33 and the rear right pillar 34.

In the case body 3 having the above construction, the sheet feeding cassette 6 is housed in the lower space 2*a* under the partition plate 35 and the image forming device 8 is housed in the upper space 2*b* above the partition plate 35. In this manner, the partition plate 35 prevents the developer scattering from the image forming device 8 from dropping on the sheet housed in the sheet feeding cassette 6. The image forming device 8 is attached to or detached from the aperture 45 formed in the front side plate 36. In addition, the image forming device 8 is positioned with respect to the front side plate 36 and the rear side plate 37 by inserting the positioning pins into the positioning holes formed in the front side plate 36 and the rear side plate 37.

Further, in a space surrounded by the front mounting plate 47 and the rear mounting plate 48 and the top plate 91, the fixing device 9 and the sheet ejecting device 10 are disposed. The fixing device 9 and the sheet ejecting device 10 are positioned with respect to the front side plate 36 and the rear side plate 37 to which the front mounting plate 47 and the rear mounting plate 48 are respectively secured, by inserting the positioning pins into the positioning holes formed in the front mounting plate 47 and the rear mounting plate 48. Incidentally, on the top plate 91 or the upper beam 95, an image reading unit (not shown) can be disposed.

Also, a bottom face of the case body 3 is surrounded by the front beam 81, a lower edge of the rear side plate 37, the lower edge portion 52*a* of the lower left side plate 52 of the left side plate 38 and a lower edge of the conveying frame 39 and opens in a rectangular shape. That is, the case body 3 has no bottom plate which has been provided conventionally.

In addition, the partition plate 35 is secured to the front left pillar 31 and the rear left pillar 33 at the front left corner and the rear left corner by screws and is also secured to the front side plate 36, the rear side plate 37 and the lower left side plate 52 by screws. Further, on a right side of the partition plate 35, the conveying frame 39 is secured to the front right pillar 32, the rear right pillar 34, the front side plate 36 and the rear side plate 37 by screws. In this manner, the lower left side plate 52, the partition plate 35 and the conveying frame 39 are connected to each other in a U-shape of which a lower side opens, when seen from a front side of the lower space 2*a*. Furthermore, the rear side plate 37, the lower left side plate 52 and the vertical guiding part 56 of the conveying frame 39 are connected to each other in a U-shape of which a front side opens, when seen from an upper side of the lower space 2*a*.

As has been described hereinabove, since the case body 3 of the color printer 1 of the present disclosure does not have the bottom plate and the front side plate of the lower space 2*a*, which have been conventionally made of a metal plate material, weight reduction of the case body 3 can be achieved. Further, since the conveying frame 39 is compatibly employed as a right side plate, cost reduction is possible. However, in a case where the bottom plate or the front side plate is not provided, there is concern about lowering of the rigidity of the case body 3. In particular, since the conveying frame 39 made of a resin material is compatibly employed as the right side plate, there is a concern about lowering of the rigidity of the right side face of the case body 3.

However, according to the present disclosure, on the right side face of the case body 3, the column-shaped projections 61 formed in the conveying frame 39 enter the hollow parts of the front right pillar 32 and the rear right pillar 34 and then are integrally coupled to each other to form a pillar-shaped structure partially having a double structure, and the rigidity of the right side face of the case body 3 can be thereby enhanced.

Further, since the conveying frame 39 is secured to the front side plate 36 and the rear side plate 37, the rigidity of the right side face of the case body 3 can be more enhanced. In addition, since the conveying frame 39 is coupled to the partition plate 35 via the front side plate 36 and the rear side plate 37, the rigidity between the partition plate 35 and the right side face of the case body 3 can be ensured as well.

Further, since the partition plate 35 is secured to the front left pillar 31 and the rear left pillar 33 by screws and the front end face, the rear end face and the left end face of the partition plate 35 are respectively secured to the front side plate 36, the rear side plate 37 and the lower left side plate 52 by screws, a sufficient rigidity can be ensured.

Furthermore, since the lower left side plate 52, the partition plate 35 and the conveying frame 39 are coupled into a U-shape of which the lower side opens, when seen from a front side of the lower space 2*a*, an impact applied to a bottom of the color printer 1 can be dispersed to the pillars 31, 32, 33, 34. In a case where the bottom plate is provided, the impact concentrates on the bottom plate and then a deformation or the like of the bottom plate or each of the side plates is easy to occur; and however, by dispersing the impact, such deformation of the bottom plate or each of the side plates can be thereby prevented.

Still furthermore, since the rear side plate 37, the lower left side plate 52 and the conveying frame 39 are coupled into a U-shape of which the front side opens, when seen from an upper side of the lower space 2*a*, when a load is applied to the case body 3 in the vertical direction, the load can be dispersed and received by each of the pillars 31, 32, 33, 34.

Yet furthermore, since the front right pillar 32 and the column-shaped projection 61 are supported by the rubber legs 84 via the front beam 81, it is possible to disperse and absorb the weight of the case body 3 to the front right pillar 32 and the column-shaped projection 61 or to disperse and absorb the impact applied from a lower side to the front right pillar and the column-shaped projection 61. Therefore, a deformation or the like of the front right pillar 32 or the conveying frame 39 can be prevented. In particular, since the column-shaped projection 61 is supported by the depression 81*a* of the front beam 81 at four corners having a high rigidity, the rigidity of the pillar-shaped structure can be further enhanced.

Further, since the rotating supporting parts 59 to rotatably support the conveying unit 40 are integrally formed with the conveying frame 39, an accumulative tolerance can be reduced and the positioning precision of the conveying frame 39 and the conveying unit 4 is therefore improved.

Therefore, the sheet can be conveyed with a high precision, and an image of high quality can be formed. Also, although the conveying frame 39 has a complicated structure having the rotating supporting parts 59 and the column-shaped projection 61 or the like, since these elements can be integrally formed by using a resin material, the number of parts can be reduced, causing cost reduction.

In addition, since the image forming device 8 and the fixing device 9 are positioned by the front side plate 36 and the rear side plate 3, it makes possible to reduce an accumulative tolerance depending upon dimensional precision of members to support these devices. Therefore, alignment of the image forming device 8 and the fixing device 9 can be held with a high precision, and image forming of high quality can be carried out.

Incidentally, as the front right pillar 32, an angular material-shaped member having an L-shaped cross section or the like can also be used; and however, it is preferable to use a channel material-shaped member having a U-shape cross section in view of the fact that there are more portions having a double structure and a certain rigidity is therefore obtained.

In addition, although, in the embodiment, the conveying frame 39 has a structure having the horizontal guiding part 55 and the vertical guiding part 56, the horizontal guiding part 55 does not always need to be provided. However, since the rigidity can be more enhanced by securing the conveying frame 39 to the front side plate 36 and the rear side plate 37, it is preferable to provide the horizontal guiding part 55. Also, in order to enhance the rigidity, a right side plate may be disposed on the right side of the hollow space 2 in addition to the conveying frame 39.

Further, although the embodiment described a case in which the column-shaped projections 61 are formed at the front side end and the rear side end of the conveying frame 39, the column-shaped projection 61 may be formed at the front side end only. Furthermore, although the conveying frame 39, the front right pillar 32 and the rear right pillar 34 are integrally coupled by securing the column-shaped projections 61 to the front right pillar 32 and the rear right pillar 34 by screws, these elements may be integrally coupled by welding or the like other than screw tightening.

Incidentally, in order to prevent entry of dust or the like through the opening of the bottom face, a bottom plate formed of a material of light weight, such as resin, can also be provided in the opening. In this case also, weight reduction is possible in comparison with the bottom plate made of a metal plate material.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising a case body having a hollow space in which a sheet storing part and an image forming part are to be housed, wherein the case body has:

four pillars respectively disposed at four corners of the hollow space; and a conveying frame disposed between adjacent two pillars of the four pillars and configured to form a conveying path of a sheet from the sheet storing part to the image forming part, wherein the conveying frame has at least one vertical column-shaped projection on a pillar side end face, the vertical column-shaped projection being integrally coupled to the pillar, the pillar has a substantial U-shaped cross section having a hollow part, and the column-shaped projection has a square-pipe shape of a rectangular shaped cross section, and the column-shaped projection enters the hollow part of the pillar and is secured to the pillar to be integrally coupled to the pillar.

2. The image forming apparatus according to claim 1, wherein a supporting member configured to support a weight of the pillar is provided under a lower end of the pillar and a lower end of the column-shaped projection abuts against the supporting member.

3. The image forming apparatus according to claim 1, comprising an exterior cover rotatably provided outside of the conveying frame, wherein a rotatably supporting part of the exterior cover is integrally formed with the conveying frame.

4. The image forming apparatus according to claim 1, wherein the pillar is made of a metallic material and the conveying frame is made of a plastic material.

5. An image forming apparatus comprising a case body having a hollow space in which a sheet storing part and an image forming part are to be housed, wherein the case body has:

four pillars respectively disposed at four corners of the hollow space; and a conveying frame disposed between adjacent two pillars of the four pillars and configured to form a conveying path of a sheet from the sheet storing part to the image forming part, wherein the conveying frame has at least one vertical column-shaped projection on a pillar side end face, the vertical column-shaped projection being integrally coupled to the pillar, wherein the case body further has:

four surrounding members respectively disposed at four sides of the hollow space; and a rectangular partition plate configured to partition the hollow space into an upper space and a lower space, wherein the partition plate is secured to at least any one pillar of the four pillars and is secured to at least any one surrounding member of the four surrounding members.

6. The image forming apparatus according to claim 5, wherein the four surrounding members have a front side plate, a rear side plate, a left side plate and a right side plate, and the front side plate, the rear side plate, the left side plate and the right side plate are secured to the pillars at four corners of the hollow space.

7. The image forming apparatus according to claim 6, wherein the image forming part is housed in the upper space and the sheet storing part is housed in the lower space, and the conveying frame is compatible with either the left side plate or the right side plate and is secured to the front side plate and the rear side plate.

8. The image forming apparatus according to claim 7, wherein the image forming part includes:

an image forming device configured to carry out image forming on the sheet conveyed along the conveying frame; and a fixing device to fix the image formed by the image forming device to the sheet, and the front side plate and the rear side plate have positioning parts configured to position the image forming device and the fixing device.

9. The image forming apparatus according to claim 6, wherein the partition plate, the left side plate and the right side plate are integrally coupled into a U-shape of which a lower side opens, when seen from a front side of the lower space.

10. The image forming apparatus according to claim 6, wherein the rear side plate, the left side plate and the right side plate are integrally coupled into a U-shape of which a front side opens, when seen from an upper side of the lower space.

* * * * *